US006128787A

United States Patent [19]

Krist et al.

[11] Patent Number: 6,128,787

[45] Date of Patent: Oct. 10, 2000

[54] FLUSH SYSTEM

[75] Inventors: Dieter Krist, Winnenden; Bernd Hanel, Fellbach, both of Germany

[73] Assignee: E. Missel GmbH & Co., Stuttgart, Germany

[21] Appl. No.: 09/258,468

[22] Filed: Feb. 26, 1999

[30] Foreign Application Priority Data

Feb. 26, 1998 [DE] Germany ..... 298 03 394 U

[51] Int. Cl.[7] ..... E03D 1/00

[52] U.S. Cl. ..... 4/300; 4/252.2; 4/252.3; 4/343; 4/419

[58] Field of Search ..... 4/300, 312, 353, 4/420, 670, 695, 251.1, 251.2, 252.1, 252.2, 252.3, 252.4, 252.5, 252.6

[56] References Cited

U.S. PATENT DOCUMENTS

| | | | |
|---|---|---|---|
| 5,090,064 | 2/1992 | Breitenberger | 4/252 R |
| 5,150,480 | 9/1992 | Schmucki | 4/252.3 |
| 5,167,040 | 12/1992 | Lechner | 4/252.2 |
| 5,210,883 | 5/1993 | Weber et al. | 4/252.2 |
| 5,253,373 | 10/1993 | Tsipov | 4/343 |
| 5,396,667 | 3/1995 | Egli et al. | 4/419 |

FOREIGN PATENT DOCUMENTS

| | | | |
|---|---|---|---|
| WO 94/06975 | 3/1994 | European Pat. Off. | 4/252.2 |
| WO 94/21866 | 9/1994 | European Pat. Off. | 4/300 |
| 0731223A1 | 9/1996 | European Pat. Off. . | |
| 689125 | 9/1930 | France . | |
| 700109 | 2/1931 | France . | |
| 2739116 | 9/1995 | France . | |
| 636750 | 1/1995 | Germany | 4/252.2 |
| WO93/21397 | 10/1993 | WIPO . | |

*Primary Examiner*—Henry J. Recla
*Assistant Examiner*—Khoa Huynh
*Attorney, Agent, or Firm*—Townsend and Townsend and Crew LLP

[57] ABSTRACT

Flushing system for a flushing toilet, comprising a built-in frame (14); a container (10) for the intermediate storage of a predeterminable quantity of water of preferably about 5 to 10 L; and a mounting (18) for a toilet bowl or a urinal, wherein the built-in frame (14) has installation elements (12), which are designed for an installation at the walls of a 90°-room corner; the mounting (18) is provided on the built-in frame (14); the width (B) of the built-in frame is substantially only determined by the rear width of the toilet bowl; and the shaping of the container (10) is matched to the space which is present through the installation of the built-in frame in a 90°-room corner.

26 Claims, 3 Drawing Sheets

FLUSH SYSTEM

BACKGROUND OF THE INVENTION

The invention relates to a flushing system for a flushing toilet with a built-in frame, a container for the intermediate storage of a predeterminable quantity of water of preferably about 3 to 10 liters and a mounting for a toilet bowl or a urinal.

Flushing systems for the intermediate storage of a predeterminable quantity of water in the form of flushing cisterns for WC installations have been known for a long time. The usually relatively voluminous, parallelepiped-shaped flushing systems have hitherto generally either been accommodated on a wall or, in the case of an under-plaster installation, in a built-up wall. Despite these different types of installation, essentially nothing has changed with regard to the shaping and function of these flushing systems. As a rule, they require a front wall, whereby a relatively large amount of valuable living space is regularly taken up.

In particular with an installation across a corner, the previously known inbuilt flushing systems, which have a width of about 50 cm and a thickness of about 12 cm, could not be accommodated in a space-saving manner as a result of these dimensions.

SUMMARY OF THE INVENTION

It is an object of the invention to provide a flushing system of the initially named kind which, with a minimum space requirement, in particular when arranged in a corner, and with a pleasing room design, enables a problem-free, rapid installation.

This object is attained with a built-in frame that has installation elements which are designed for an installation on the walls of a 90°-room corner. In this way the built-in frame of the invention is already so prepared that it can be erected and fully installed in a room corner, which is formed by two walls which meet one another at right angles, without further auxiliary means being required.

Furthermore, the mounting for the toilet bowl or the like is provided in accordance with the invention on the built-in frame, so that here no further installation carriers are required, because the toilet bowl can be reliably mounted on the self-supporting built-in frame.

A further element of the solution of the invention is the width of the built-in frame, which, in accordance with the invention, is essentially only specified or determined by the rear width of the toilet bowl. In other words, the width of the built-in frame is so selected that it essentially corresponds to the rear width of the toilet bowl, so that the total built-in frame can be placed relatively close to the room corner.

Finally, the shaping of the container is matched to the space, which is predetermined by the installation of the built-in frame in the 90°-room corner. This special measure makes it possible, despite a very low width of the built-in frame and a likewise very low build-in depth, to make the required flushing volume available, in that the shaping of the container is not selected in a customary manner, but rather is adapted to the minimized space available in the corner.

The flushing system of the invention requires a minimum base surface and can be erected in a room corner, so that a build-in depth of only about 20 cm can be achieved.

As a result of the combination of features of the invention, the flushing system can be installed in a relatively space-saving manner in a room corner, so that it is possible to dispense with the previously customary cost-intensive front wall construction and installation. In total, an advantageous layout of the room results, with an appealing design and a minimum space requirement. A high-standing reliability is ensured, which is in particular of advantage when used for a wall-suspended WC. The tubular container can, for example, be round, oval, polygonal, for example triangular in cross-section, or designed in accordance with any desired combination of these cross-sections.

In accordance with a first advantageous embodiment, the build-in depth of the built-in frame, i.e. its extent from its front edge up to and into the room corner, amounts to about 18 to 25 cm, preferably to about 20 to 23 cm. With this embodiment a flushing system is provided which does not take up much more space in a room corner than a customary toilet brush.

The width of the built-in frame preferably amounts to about 22 to 44 cm, preferably to approximately 24 to 40 cm. In this connection the width of the built-in frame does not have to precisely correspond to the rear width of the toilet bowl. Rather, for static and aesthetic reasons, a small spacing can be left at both sides of the toilet bowl.

The height of the built-in frame preferably amounts to about 90 to 105 cm. In this way the flushing system of the invention has an erected height—also with erection by means of a foot—which can readily be reached by children and adults. It is, however, also possible to form the built-in frame with a height of about 70 cm. In this case the built-in frame can be installed directly on a wall, optionally with the aid of a wall bracket or the like.

It is particularly advantageous if the cross-sectional shape of the container is matched to the cross-sectional shape of the built-in frame. In this way the container height can be minimized, which is advantageous from a technical, acoustic viewpoint.

In accordance with a further embodiment of the invention, the built-in frame has a horizontal cover plate which can be provided with an opening. On the one hand, the stability of the built-in frame is increased by such a cover plate. On the other hand, an inspection cover or actuating element can be mounted on such a cover plate.

In accordance with a further embodiment of the invention, the container is essentially of tubular shape, whereby components easy to manufacture can be used despite the optimized manner of design.

The built-in frame is preferably acoustically decoupled from the container, which is supported on it or suspended in it. In this connection an integrated acoustically decoupled pre-manufacture of the built-in frame and container is also possible.

In a preferred embodiment the built-in frame is provided with an adjustable standing foot, whereby an ideal adaptation to the respective inbuilt situation and to the floor construction is possible. This standing foot can in particular be adjustable at inner or outer struts of the built-in frame. Alternatively, a bracket can be used.

The built-in frame can include two vertical side parts which are parallel to one another and one or more transverse struts, which connect these together. The side parts can have a different and in particular smaller spacing from one another in the region of a waste water connection bend than in the remaining region. The installation elements are preferably provided on the vertical side parts.

It is of advantage if the built-in frame is provided with a horizontal cover plate or a cover frame adapted to the respective inbuilt situation, which, for example, has an opening in which an actuating element can be installed. In this arrangement an actuation of a run-out fitting associated with the container can, for example, take place via this element, which can, for example, be a push-button or the like.

In a preferred embodiment, the built-in frame has a lower support, an upper support and/or a suspension device, on which or at which the tubular container is, for example, supported via a preferably acoustical decoupling part, such as in particular a rubber section and/or the like. In another preferred embodiment, the container is suspended in an acoustically decoupled manner in the built-in frame via spigots and supported in the latter.

The container can be fixed by at least one acoustic decoupling means, such as in particular a clamping band, acoustically decoupled spigots, a suspension device and/or the like, at the built-in frame. Thus, a simple cable strap or the like is, for example, already sufficient in order to fix the container to the built-in frame in the desired acoustically decoupled manner.

In a preferred embodiment a connection tube, a waste water connection bend and/or a WC mounting is securable or at least lockable to the built-in frame, apart from the preferably tubular container. In this connection, for the mounting of the connection tube and/or of the waste water connection bend, a respective clamp connection can, for example, be provided, via which the connection tube or the waste water connection bend is securable or at least lockable, preferably to a longitudinal or transverse strut of the built-in frame. In this connection the waste water connection band must be pivotally mounted and lockable. The container, which is supported on a lower support or suspended from an upper support, is expediently simultaneously centered via the respective support and/or by spigots or the like.

The built-in frame can optionally also be mounted on a solid flat wall, on lightweight walls and/or in rail and frame systems via additional angle brackets.

A telescopic double foot having a lower flat section securable to the floor of the room and preferably provided with a plurality of elongate holes is preferably provided as the adjustable standing foot.

The container, the connection tube, the waste water connection bend and/or a water connection associated with the container are preferably surrounded at least partly and at points where a structure-borne noise is transmitted by an insulating material. The insulating material can also be an element of the built-in frame, at least regionally. Here bonded-on or inserted, acoustically decoupling, soft and at least flexible materials are conceivable.

In the embodiment preferred in practice, tile carriers are provided, by which the installed built-in frame can be covered except for the opening of the cover plate, the threaded bars, the opening of the connection tube and/or the opening of the waste water connection bend.

Building protection parts are expediently provided, which can be inserted into the opening of the cover plate or of the cover frame, into the opening of the connection tube and/or into the opening of the waste water connection bend.

Finally, the opening of the cover plate or of the cover frame can, for example, be closed by a cover which receives the actuating element, with the actuating element consisting of one or of a plurality of parts. In this connection the cover plate or the cover frame is expediently provided with mounting lugs, via which both the relevant building protection part and also subsequently the cover which receives the actuating element can be fixed.

With the flushing system of the invention the relevant container can thus be mounted in a room corner, without the fore-part of masonry or hollow cavity rail systems customary at straight walls. In this way the space requirement is reduced to a minimum with low building costs, which in particular leads to an increased freedom of movement in small rooms. Moreover, the possibility exists of an interesting, design-optimized bathroom layout. The built-in corner depth required with an installation in a room corner is minimal. The flushing system can be combined with the container in an ideal acoustically decoupled manner at the works. Moreover, a problem-free and rapid installation is ensured. After setting the height of the waste water connection bend by means of the adjustable standing foot in accordance with the built-up height of the floor, the drill holes can be marked and the built-in frame can be secured in the room corner, in particular by means of screws. In this connection a water connection is, for example, possible from the left or from the right. A simple adaptation to the respective inbuilt situation is in particular possible in that the waste water connection bend is pivotable. The adaptation is also possible in that the lateral elongate struts of the built-in frame are cut out or arranged offset in the region of the connection line.

BRIEF DESCRIPTION OF THE DRAWINGS

The invention will be explained in more detail with reference to the following drawings.

DESCRIPTION OF THE PREFERRED EMBODIMENTS

Figure 1:
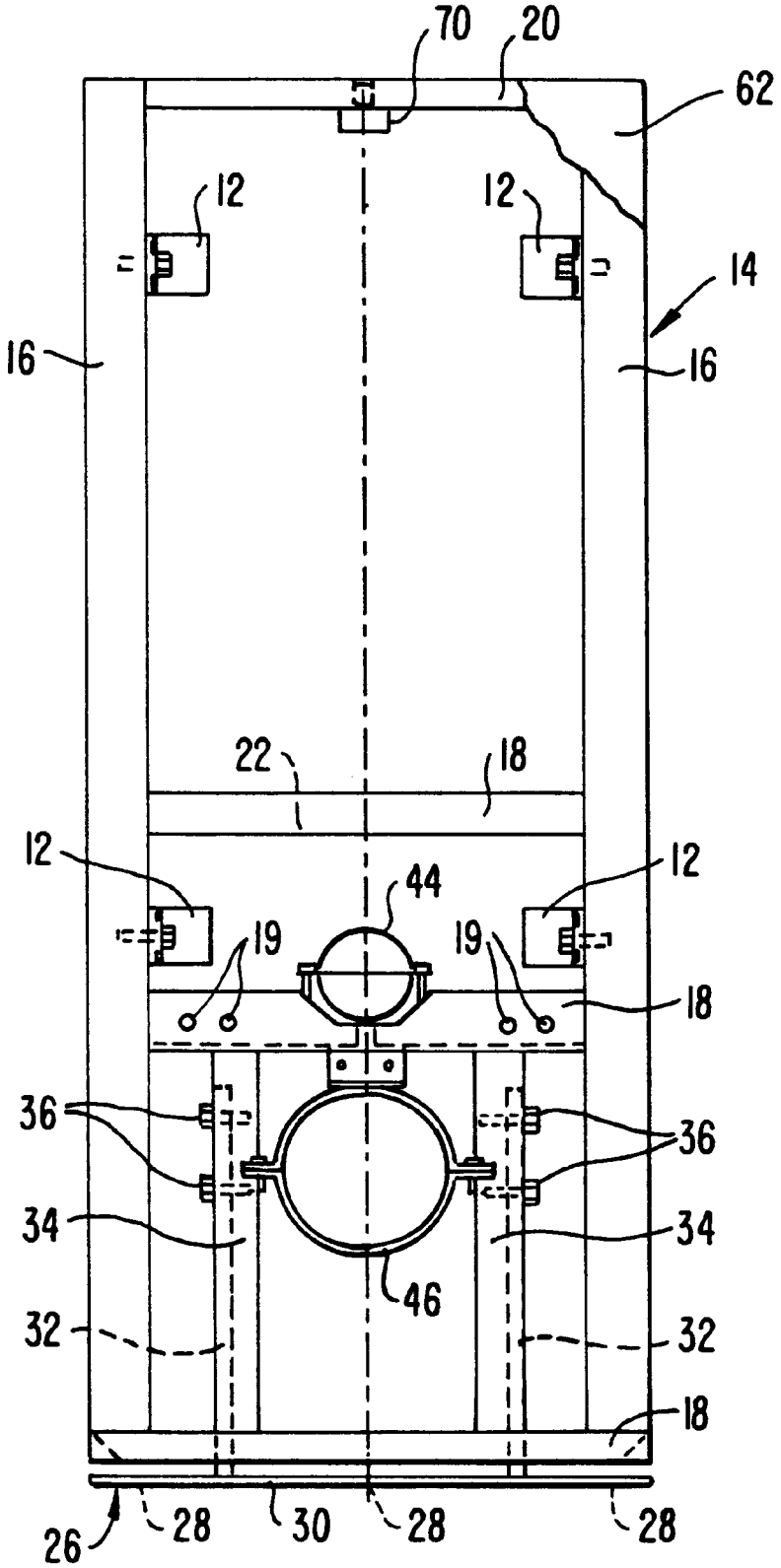
FIG. 1 is a front elevational view of an embodiment of a flushing system.
Figure 2:
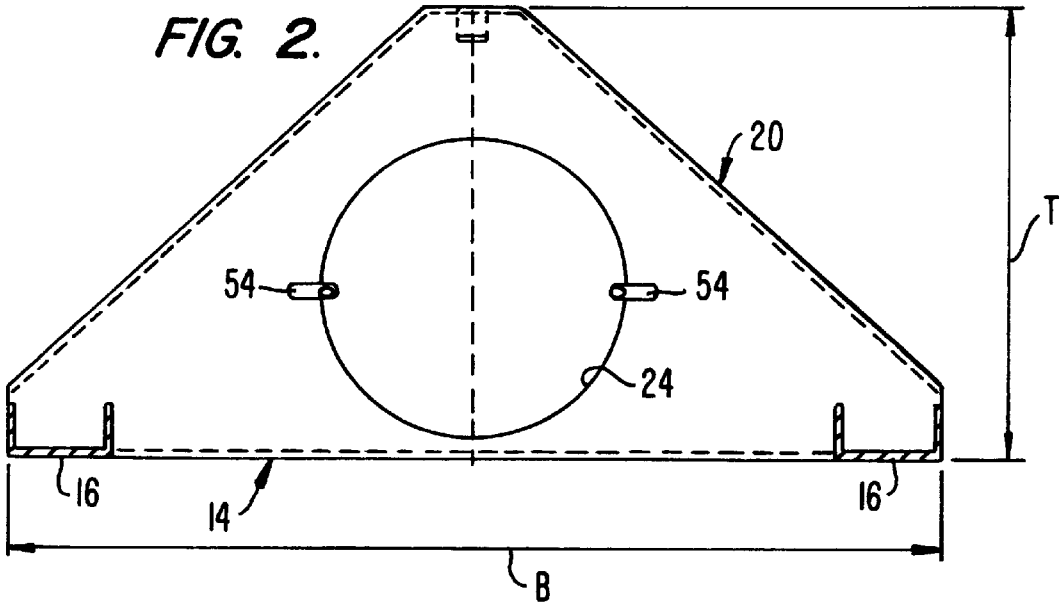
FIG. 2 is a plan view of the flushing system shown in FIG. 1.
Figure 3:
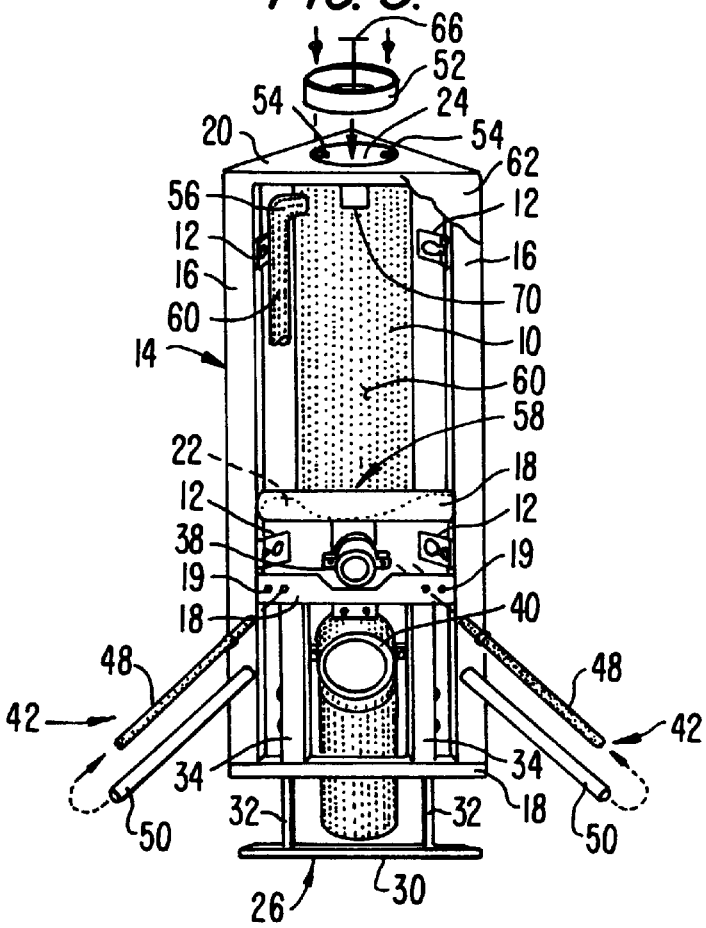
FIG. 3 is a perspective view of the flushing system shown in FIG. 1.

FIGS. 1 to 3 show a flushing system with a built-in frame 14 for the positioning and mounting of a container 10 (see FIG. 3) for the intermediate storage of a predeterminable quantity of water, with this predeterminable quantity of water being controllably releasable, and with a corresponding quantity of water being removable again from a mains supply via an automatically acting valve supply arrangement for a renewed intermediate storage.

This flushing system comprises an elongate built-in frame 14, which can be installed vertically in a 90°-room corner via installation elements in the form of angle brackets 12, and by which an elongated, essentially tubular container 10 (see FIG. 3) is positionable in a vertical alignment in the room corner.

In the present embodiment the built-in frame 14 is combined with the container 10 at the factory works, with the built-in frame being acoustically decoupled from the container 10 supported on it.

The built-in frame 14 comprises two parallel vertical side parts 16, a plurality of transverse struts 18, which connect these to one another, and also a cover plate 20, which, in the present case, has a generally triangular outline (see FIGS. 2 and 3).

In this connection the container 10 is provided between a support 22 provided on a middle transverse strut 18 and the cover plate 20. The tubular container 10 is supported on the support 22 via an acoustically decoupling part 58, such as in particular a rubber section and/or the like. The container 10 can be simultaneously centered by the support 22.

Moreover, the container 10 can be fixed to the built-in frame 14 in the upper region by at least one acoustically decoupling means 70, such as in particular a clamping band and/or the like. A simple cable tic and/or the like can be used for this purpose.

As can be seen from FIGS. 1 and 3, the angle brackets 12 are provided at the vertical side parts 16, with the angle brackets 12 being so bent and installed that they substantially contact the room walls when the flushing system is positioned in a 90°-room corner. The cover plate 20 has an opening 24 (see FIGS. 2 and 3), in which a hand-actuating element 66 can be installed, via which a run-out fitting associated with the hand-actuating element can be actuated.

The built-in frame 14 is provided with an adjustable standing foot 26, which in the present case is formed as a telescopic double foot with a lower flat section 30, which can be secured to the room floor and which is provided with a plurality of elongate holes 28. Two parallel, upwardly projecting vertical bars 32 are secured to the flat section 30 and are vertically adjustably guided in two parallel vertical rails 34, which respectively extend between the two lower transverse struts 18. The two vertical bars 32 can be fixed in the guide rails 34 by bolts 36 or the like.

Apart from the tubular container 10, a connection tube 38 and a waste water connection bend 40 can be secured to the built-in frame 14 (see FIG. 3). As FIGS. 1 and 3 show, the second transverse strut 18 from the bottom of the built-in frame 14 serves as the mounting for a toilet bowl or a urinal or the like. For this purpose two respective pairs of reinforced threaded bores 19 are provided in this transverse strut, which serve for the attachment of bowl types with different mounting spacings. A suspension device 42 in the form of threaded bars 48 can be screwed into these threaded bores 19. A sleeve 50 can be respectively pushed onto each threaded bar 48, which serves as a protection measure at the building site.

Both the connection tube 38 and also waste water connection bend 40 are respectively secured via a clamp connection, 44 and 46 respectively, to a transverse strut 18 of the built-in frame 14. The waste water connection bend 40 can be pivotable relative to the built-in frame 14 for an ideal adaptation to the respective inbuilt situation. Moreover, the connection tube 38 is arranged at the lower side of the support 22 and connected to the latter.

The built-in frame 14 can consist at least partly of steel section and/or strip steel, of a block of plastic or of a plastic section. In the present case it is fully galvanically zinc-plated. As can be seen in particular from FIG. 2, the two vertical side parts 16 each have a U-shaped cross-section.

The built-in frame 14 can be selectively installed via additional attachment angles also on a front wall, on a solid wall (masonry, concrete), or on standard walls.

The container 10, the connection tube 38, the waste water connection bend 40 and also a water connection 56 associated with the container 10 as well as the relevant water supply line are surrounded at least substantially by an insulating material 60. In the present case, the water connection 56 is arranged at the top left.

Moreover, tile carriers 62 are provided, which are not illustrated here, by which the installed built-in frame 14 can be covered except for the opening 24 of the cover plate and the openings of the connection tube 38 and of the waste water connection bend 40. Building protection parts can be inserted into these openings, of which only the building protection part 52 intended for the opening 24 of the cover plate 20 is shown (FIG. 3).

As soon as the building protection part or cover 52 has been removed again from the opening 24 of the cover plate 20, this opening 24 can be closed by a cover which receives the hand-actuating element 66 and preferably consists of an upper part and a lower part.

For this purpose the cover plate 20 is provided in the present case with attachment lugs 54, which project into its opening 24, via which both the relevant building protection part 52 and also subsequently the lower part of the cover which receives the hand-actuating element (not shown here) can be fixed to the cover plate 20. The attachment lugs 54 can, for example, be welded to the cover plate 20.

After the required height of the waste water connection bend 40 has been set via the adjustable standing foot 26, the corresponding drill holes are marked at the two corner walls, whereupon the built-in frame 14 can be secured in the room corner by bolts via the angle brackets 12. The water connection is possible from the left or from the right. In the present case, the water connection 56, which is connected to a relevant water line and is associated with the container, is arranged at the top left (see FIG. 3). The waste water connection bend 40 is pivotable in the present case.

The build-in depth T (see FIG. 2) of the illustrated built-in frame amounts to only 21 cm. The width B of the built-in frame amounts to only 36 cm. The height of the built-in frame 14 without standing foot 26 amounts to 96 cm.

As FIGS. 1 and 3 furthermore show, the width of the built-in frame 14 is essentially only determined by the rear width of the toilet bowl, since only a little space remains between the mounting bores 19 at the carrier 18 and the lateral edge of the built-in frame.

Figure 4:
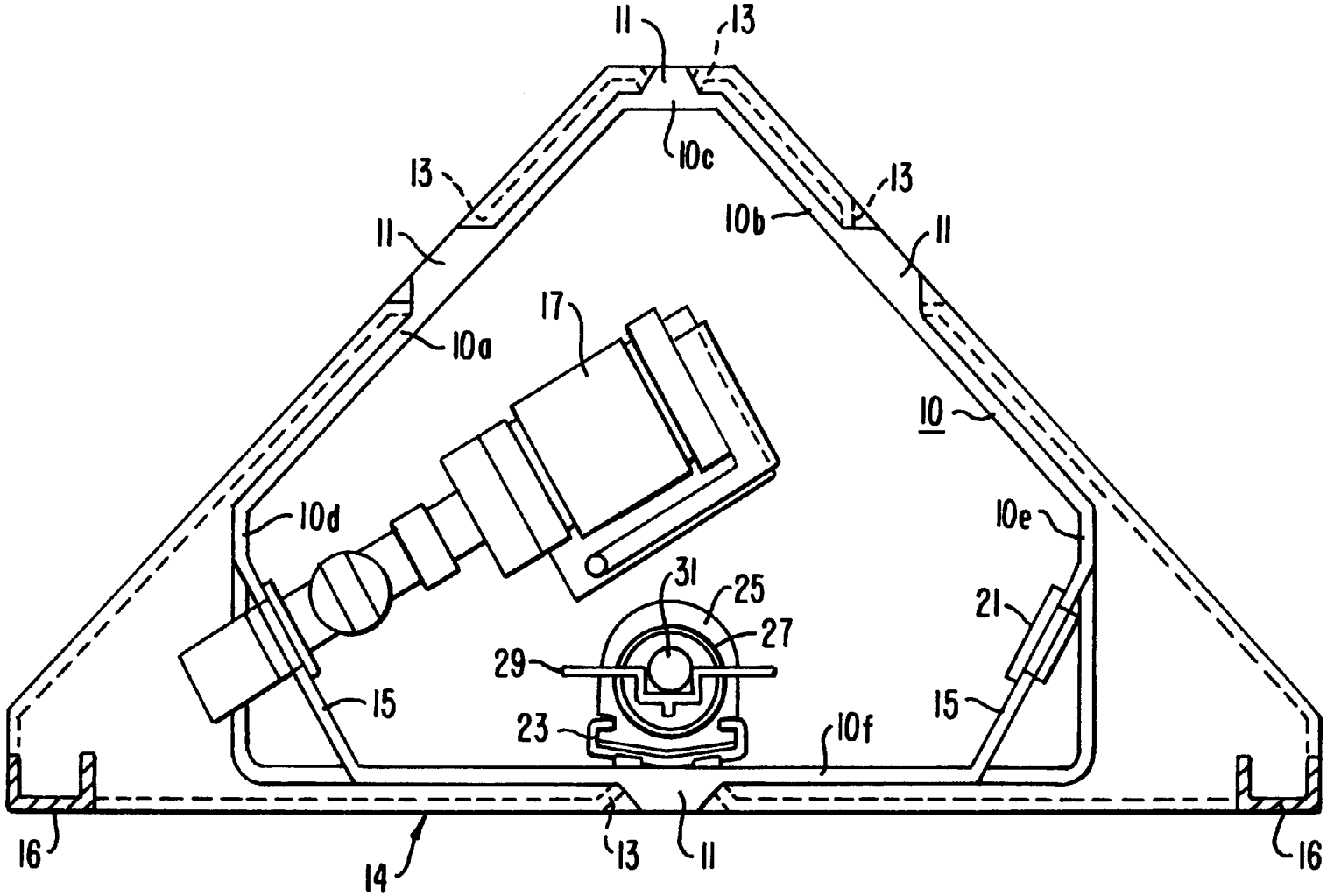
FIG. 4 is a plan view of an alternative flushing system.

FIG. 4 shows a plan view of a further embodiment of a flushing system with a built-in frame 14, which has two vertical side parts 16 and also a container 10. In this embodiment the built-in frame 14 corresponds essentially to that of FIGS. 1 to 3. The container 10 is, however, in this embodiment, not tubular shaped, but rather has a cross-sectional shape which is more adapted to the cross-sectional shape of the built-in frame 14.

Two side walls 10*a* and 10*b* of the container shown in FIG. 4 extend parallel to the obliquely extending boundaries of the built-in frame 14. Between these two walls 10*a* and 10*b* there is provided a short connection wall 10*c*. A respective hook 11 is molded onto the walls 10*a*, 10*b* and 10*c* of the container 10 and engages into a corresponding bent-out portion of the built-in frame 14, whereby the container can be suspended in a manner decoupled from structure borne noise in the built-in frame 14, preferably via intermediate insulating elements.

Respective, mutually parallel wall sections 10*d* and 10*e* adjoin the two obliquely extending side walls 10*a* and 10*d* and are connected by a side wall 10*f* extending at right angles thereto. A hook 11 is molded onto the side wall 10*f* and engages into a bent-out portion 13 of the built-in frame 14.

The container shown in FIG. 4 has in its upper region two web sections 15, which are formed in one piece with the container wall and form a mounting bridge for a filling valve 17, which is guided through a bore in the left-hand web section 15 in FIG. 4 and screwed there. A bore is likewise provided in the right-hand web section 15 in FIG. 4, and is closed with a plug 21, so that the filling valve 17 can be installed both at the left-hand side and also at the right-hand side.

Furthermore, a guide rail 23 is secured to the side wall 10*f* of the container 10, in which a device 25 providing security against rotation of a (non-illustrated) run-out valve is secured. The run-out valve can be opened by downward pressing, with the pressure movement being transmitted via an overflow tube 27 to the run-out valve, which is connected to the device 25 providing security against rotation. The reference numeral 29 designates a contact vane, which is connected to an actuating bar 31, which can be triggered by an (non-illustrated) actuating element, for example a pusher. Through pressure on the actuating element, the actuating bar 31 is pressed downwardly, whereby the contact vane 29 is likewise pressed downwardly and the overflow tube 27 is moved downwardly, so that the outlet valve opens.

In addition to the cylindrical shape of the container 10 shown in FIGS. 1 to 3 and the shape shown in FIG. 4, which represents a house in cross-section, a plurality of further cross-sectional or volume shapes is possible. Important is in any event that the shaping of the container is adapted to the (minimized) space, which is preset by the installation of the built-in frame 14 in a 90°-room corner.

What is claimed is:

1. Flushing system for a flushing toilet and for mounting a toilet bowl or a urinal, the toilet bowl or urinal having an aft side defining a mounting surface of a predetermined horizontal width, the system comprising:

a built-in frame for installing the flushing system in a 90°-room corner, the built-in frame including first and second spaced-apart vertical front parts; a plurality of transverse struts connecting the vertical front parts to one another; a generally triangular horizontal cover plate having a base section bridging the first and second vertical front parts and a right-angled corner for facing an intersection defined by two walls forming the 90°-room corner; and installation elements associated with the vertical front parts for attachment to the two walls forming the 90°-room corner;

a mounting on a front side of the built-in frame for holding one of the toilet bowl and the urinal, the front side of the built-in frame having a width substantially equal to the predetermined horizontal width of the mounting surface; and an elongated water container holding between about 5 to 10 liters of water, the container being disposed inside the built-in frame in substantially vertical alignment with the vertical front parts, the container being shaped to fit into a space which is formed by the built-in frame and the walls of the 90°-room corner when the system is installed.

2. Flushing system in accordance with claim 1 wherein the built-in frame has a depth of about 18 to 25 cm.

3. Flushing system in accordance with claim 1 wherein the front side of the built-in frame has a width in the range of between approximately 22 to 44 cm.

4. Flushing system in accordance with claim 1 wherein the built-in frame has a height in the range of between 70 to 105 cm.

5. Flushing system in accordance with claim 1 wherein the built-in frame has a given cross-sectional shape, wherein a cross-sectional shape of the container is matched to the given cross-sectional shape of the built-in frame, and wherein a part of the container wall extends parallel to the walls of the 90°-room corner.

6. Flushing system in accordance with claim 1 wherein the horizontal cover plate has an opening.

7. Flushing system in accordance with claim 1 wherein the container is substantially tubular.

8. Flushing system in accordance with claim 1 including at least one of a clamping band and a suspension device fixing the container to the built-in frame.

9. Flushing system in accordance with claim 1 including a connection tube and a waste water connection bend secured to the built-in frame apart from the container.

10. Flushing system in accordance with claim 9 wherein at least one of the connection tube and the waste water connection bend is connected to the built-in frame with a clamp connection.

11. Flushing system in accordance with claim 9 wherein at least one of the connection tube and the waste water connection bend is secured to a transverse strut of the built-in frame.

12. Flushing system in accordance with claim 1 including a support for the container which centers the container in the built-in frame.

13. Flushing system in accordance with claim 1 including two threaded rods which are screwed into the mounting.

14. Flushing system in accordance with claim 1 wherein the built-in frame comprises at least in part one or more of a steel section, a steel strip, a block of plastic and a plastic section.

15. Flushing system in accordance with claim 1 wherein the built-in frame is at least in part covered by a paintable, corrosion-resistant protecting layer.

16. Flushing system in accordance with claim 1 including means acoustically decoupling the container from the built-in frame.

17. Flushing system in accordance with claim 1 including a telescopic double foot having a lower flat section securable to a floor and provided with a plurality of elongate floor mounting holes.

18. Flushing system in accordance with claim 1 including an insulating material substantially surrounding the container, a connection tube, a waste water connection bend and a water connection associated with the container for limiting the transmission of structure-borne noise.

19. Flushing system in accordance with claim 1 including tile carriers connected to the built-in frame for at least partially covering the built-in frame with tiles.

20. Flushing system in accordance with claim 1 wherein the cover plate includes an opening, and including a cover for closing the opening and which is adapted to receive an actuating element.

21. Flushing system in accordance with claim 20 wherein the cover plate is provided with mounting lugs for fixing the cover to the cover plate.

22. Flushing system in accordance with claim 1 wherein the built-in frame includes a lower support and an upper support for supporting the tubular container, and including an acoustic decoupling rubber part for acoustically isolating the container.

23. Flushing system in accordance with claim 1 wherein the container has a water filling volume of 6 liters.

24. Flushing system in accordance with claim 1 wherein the built-in frame and the container are constructed and arranged to generate a water pressure head of approximately 50 cm when the container is correctly filled with water.

25. A flushing system for a flushing toilet and for mounting a toilet bowl or urinal, the toilet bowl or urinal having an aft side defining a mounting surface of a predetermined width, the system comprising an upright frame having a generally triangular cross-section for positioning in a 90°-room corner, the frame having a front face of a width substantially equal to the predetermined width of the mounting surface, means for securing the mounting surface of the toilet bowl or the urinal to the front face at a location intermediate a top and a bottom end of the frame, the frame defining an interior space extending substantially to the top of the frame, means for securing the frame to walls of the room defining the 90° corner, and an elongated water container disposed in the interior space of the frame and sized to hold water for flushing the toilet bowl or urinal.

26. A flushing system for a flushing toilet and for mounting a toilet bowl or urinal, the toilet bowl or urinal having an aft side defining a mounting surface of a predetermined width, the system comprising an upright frame having a generally triangular cross-section for positioning in a 90°-room corner and defined by perpendicular, intersecting sides and a front face extending between free ends of the sides, the front face having a width substantially equal to the predetermined horizontal width of the mounting surface; means for securing the mounting surface of the toilet bowl or the urinal to the front face at a location intermediate a top and a bottom end of the frame, the frame defining an interior space of a substantially triangular cross-section extending substantially to the top of the frame; and an elongated water container disposed in the interior space of the frame only and sized to hold sufficient water for flushing the toilet bowl or urinal.

* * * * *